US005631964A

United States Patent [19]

Harada et al.

[11] Patent Number: 5,631,964

[45] Date of Patent: May 20, 1997

[54] AUDIO APPARATUS

[75] Inventors: Takeshi Harada, Mitaka; Eiki Nasu, Tokorozawa, both of Japan

[73] Assignee: Kabushiki Kaisha Kenwood, Tokyo, Japan

[21] Appl. No.: 631,910

[22] Filed: Apr. 12, 1996

Related U.S. Application Data

[63] Continuation of Ser. No. 237,849, May 4, 1994, abandoned.

[30] Foreign Application Priority Data

May 7, 1993 [JP] Japan ..... 5-131357

[51] Int. Cl.[6] ..... H04R 5/02

[52] U.S. Cl. ..... 381/74

[58] Field of Search ..... 434/307 A; 381/88, 381/89, 90, 24, 188, 205, 63

[56] References Cited

U.S. PATENT DOCUMENTS

| | | | |
|---|---|---|---|
| 3,795,769 | 3/1974 | Nowka et al. | 179/1 |
| 4,764,960 | 8/1988 | Aoki et al. | 381/90 |
| 5,117,459 | 5/1992 | McShane | 381/24 |
| 5,123,051 | 6/1992 | Koinuma | 381/63 |
| 5,321,756 | 6/1994 | Patterson | 381/24 |
| 5,485,525 | 1/1996 | Zampini et al. | 381/119 |

FOREIGN PATENT DOCUMENTS

| | | | |
|---|---|---|---|
| 0467256 | 1/1992 | European Pat. Off. | H04S 3/00 |
| 404299398 | 10/1992 | Japan | 381/63 |
| 2151439 | 7/1985 | United Kingdom | H04R 3/12 |

OTHER PUBLICATIONS

"Adding A Center Speaker For Stereo" Gerald Healy vol. 66 #2; Aug. 1961.

*Primary Examiner*—Leo Boudreau
*Assistant Examiner*—Jerome Grant, II
*Attorney, Agent, or Firm*—Sixbey, Friedman, Leedom & Ferguson, P.C.; Gerald J. Ferguson, Jr.; Eric J. Robinson

[57] ABSTRACT

Audio apparatus capable of playing music programs with desired surrounding sounds. Two sources drive two speakers having different directivities at the same time or independently. A sound field processing is performed, and the volume ratio of the two speakers having different directivities is set as desired or in accordance with a sound field pattern.

4 Claims, 12 Drawing Sheets

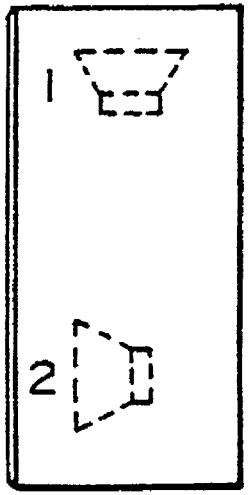
FIG.IB
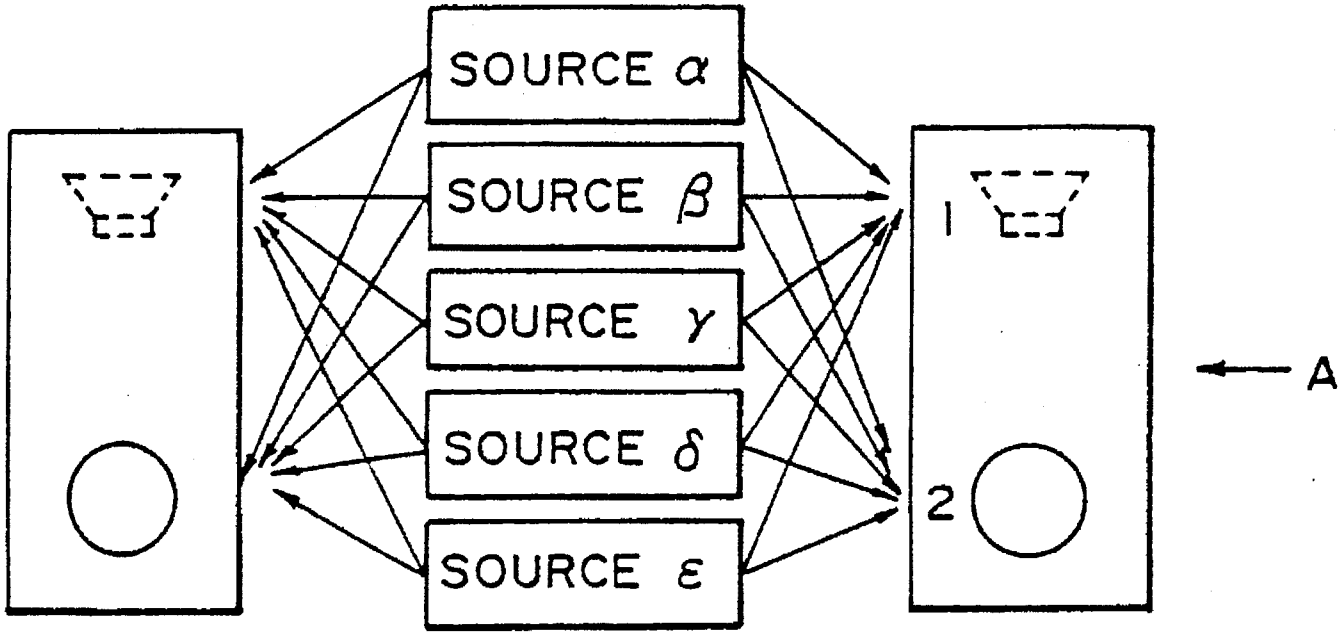
FIG.IA

| DSP MODE | SOUND VOLUME RATIO FOR SPEAKERS 1 AND 2 | |
|---|---|---|
| | 1 | 2 |
| ARENA | 8 | 22 |
| JAZZ CLUB | 10 | 20 |
| STADIUM | 10 | 20 |
| DISCOTHEQUE | 23 | 7 |
| CHURCH | 8 | 22 |
| MOVIE | 15 | 15 |
| GAME | 12 | 18 |

FIG. 13

AUDIO APPARATUS

This application is a continuation of Ser. No. 08/237,849, filed May 4, 1994, now abandoned.

BACKGROUND OF THE INVENTION

1. Field of the Invention

The present invention relates to an audio apparatus for selecting a desired source from a plurality sources and playing the selected source. More particularly, the present invention relates to an audio apparatus having a function of driving speakers having different directivities at the same time or independently by two sources, performing a sound field processing, and changing the volumes of two-channel speakers at the same time or independently.

2. Related Background Art

A conventional audio apparatus selects one source from a plurality of sources by an input selector and plays the selected source. As shown in FIG. 17A, only one musical program source is played by an R-channel speaker and an L-channel speaker.

As shown in FIG. 17B, also in the case where two R-channel speakers and two L-channel speakers are used, the same channel signal is used for driving these speakers.

In the above-described conventional audio apparatuses, a combination of source sounds is limited because only one musical program source is used, being unable to play a musical program with surrounding sounds.

SUMMARY OF THE INVENTION

The present invention has been made in consideration of the above situations. It is an object of the present invention to provide an audio apparatus having a function of driving speakers having different directivities at the same time or independently by two sources, performing a sound field processing, and changing the volumes of two-channel speakers as desired or in accordance with a sound field pattern.

According to one aspect of the present invention, there is provided an audio apparatus having: L-channel speakers including two speakers having different directivities; R-channel speakers including two speakers having different directivities; switching means for designating a plurality of sources from a plurality of sources; and an adder for adding a plurality of source sound signals designated by the switching means, wherein the signal added by the adder drives the R-channel speakers and the L-channel speakers at the same time.

According to another aspect of the present invention, there is provided an audio apparatus having: L-channel speakers including two speakers having different directivities; R-channel speakers including two speakers having different directivities; and switching means for designating a plurality of sources from a plurality of sources, wherein a source sound signal obtained by adding a plurality of source sound signals designated by the switching means and a source sound signal not subjected to addition drive the R-channel speakers and the L-channel speakers independently.

According to another aspect of the present invention, there is provided an audio apparatus having: L-channel speakers including two speakers having different directivities; R-channel speakers including two speakers having different directivities; switching means for designating a plurality of sources from a plurality of sources; sound field processing means for processing the sound field of at least one source sound signal designated by the switching means; and an adder for adding an output of the sound field processing means to a source sound signal other than the source sound signal processed by the sound field processing means, wherein the signal added by the adder drives the R-channel speakers and the L-channel speakers at the same time.

According to another aspect of the present invention, there is provided an audio apparatus having: L-channel speakers including two speakers having different directivities; R-channel speakers including two speakers having different directivities; switching means for designating a plurality of sources from a plurality of sources; sound field processing means for processing the sound field of at least one source sound signal designated by the switching means; and an adder for adding an output of the sound field processing means to a source sound signal other than the source sound signal processed by the sound field processing means, wherein a source sound signal obtained by adding a plurality of source sound signals designated by the switching means, and source sound signals not subjected to addition drive the R-channel speakers and the L-channel speakers independently.

According to another aspect of the present invention, there is provided an audio apparatus having: L-channel speakers including two speakers having different directivities; R-channel speakers including two speakers having different directivities; switching means for designating a plurality of sources from a plurality of sources; and level adjusting means for adjusting the level of at least one source sound signal designated by the switching means, wherein a source sound signal processed by the level adjusting means and a source sound signal among the selected sources not subjected to the processing by the level adjusting means drive the R-channel speakers and the L-channel speakers independently.

According to another aspect of the present invention, there is provided an audio apparatus having: L-channel speakers including two speakers having different directivities; R-channel speakers including two speakers having different directivities; switching means for designating a plurality of sources from a plurality of sources; sound field processing means for processing the sound field of at least one source sound signal designated by the switching means; an adder for adding an output of the sound field processing means to a source sound signal other than the source sound signal processed by the sound field processing means; and level adjusting means for adjusting the levels of a source sound signal added by the adder and a source sound signal not subjected to the addition, wherein the level adjusting means is automatically set in accordance with a sound field pattern set by the sound field processing means, and the signals whose levels have been set by the level adjusting means drive the R-channel speakers and the L-channel speakers independently.

According to another aspect of the present invention, there is provided an audio apparatus having: L-channel speakers including two speakers having different directivities; R-channel speakers including two speakers having different directivities; switching means for designating a plurality of sources from a plurality of sources; sound field processing means for processing the sound field of at least one source sound signal designated by the switching means; and level adjusting means for adjusting the levels of a source sound signal processed by the sound field processing means and a source sound signal among the selected sources not subjected to the sound field processing, wherein the level adjusting means is automatically set in accordance with a sound field pattern set by the sound field processing means, and the signals whose levels have been set by the level adjusting means drive the R-channel speakers and the L-channel speakers independently.

According to another aspect of the present invention, there is provided an audio apparatus having: L-channel speakers including two speakers having different directivities; R-channel speakers including two speakers having different directivities; switching means for designating a plurality of sources from a plurality of sources; sound field processing means for processing the sound field of at least one source sound signal designated by the switching means; an adder for adding an output of the sound field processing means to a source sound signal other than the source sound signal processed by the sound field processing means; and level adjusting means for adjusting the levels of a source sound signal obtained by the addition of the adder and a source sound signal not subjected to the addition of the adder, wherein the level adjusting means is manually set, and the signals whose levels have been set by the level adjusting means drive the R-channel speakers and the L-channel speakers independently.

According to the preferred embodiment of the present invention, the operation of the level adjusting means is made invalid depending upon a particular sound field pattern set by the sound field processing means, and the level ratio of the source sound signals for driving the R-channel speakers and the L-channel speakers is fixed to a predetermined level ratio.

According to an audio apparatus of the present invention, it is possible to drive two speakers having different directivities at the same time or independently by two sources, to perform a sound field processing, and to change the volumes of two-channel speakers as desired or in accordance with a sound field pattern. A musical program with surrounding sounds can be played which has been achieved by conventional audio apparatuses.

BRIEF DESCRIPTION OF THE DRAWINGS

FIG. 1A is a diagram showing the fundamental structure of an audio apparatus according to an embodiment of the present invention, and FIG. 1B is a diagram of FIG. 1A as viewed in the direction of an A arrow.

FIG. 13 shows a relationship between DSP modes and sound volumes for speakers used in the operation of the flow chart shown in FIG. 12.

DETAILED DESCRIPTION OF THE PREFERRED EMBODIMENTS

Figure 2:
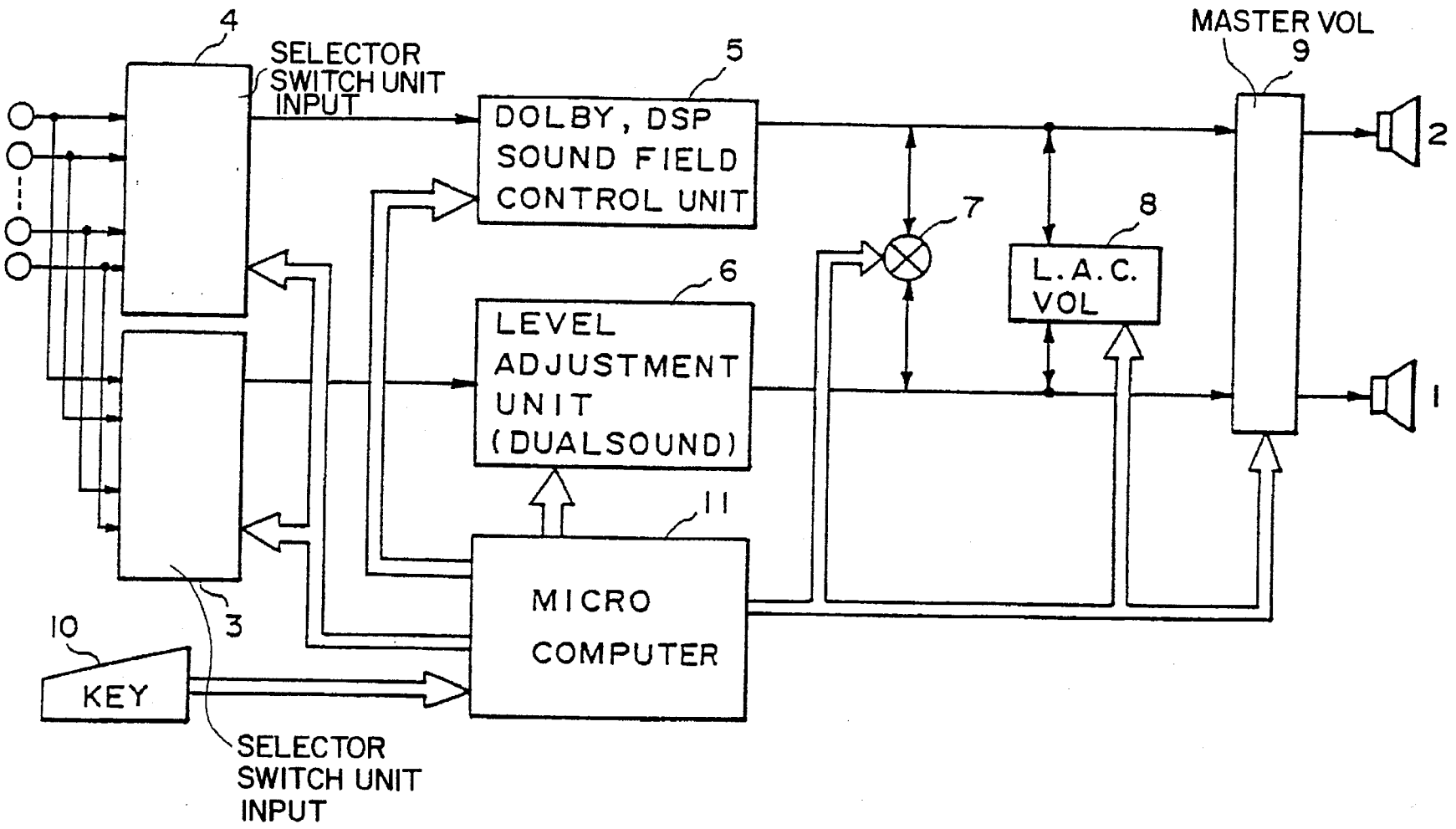
FIG. 2 is a block diagram showing the hardware configuration of an audio apparatus according to an embodiment of the present invention.

Embodiments of an audio apparatus of the present invention will be described with reference to the accompanying drawings. FIG. 2 is a block diagram showing the hardware configuration of an audio apparatus according to an embodiment of the present invention. Reference numeral 1 represents an omnidirectional speaker called an omni-top speaker, and reference numeral 2 represents a directional speaker.

The speakers 1 and 2 are mounted in a single cabinet and operate as R- and L-channel speakers. In FIG. 2, although only a single channel is shown, another pair of R- and L-channel speakers are used in reality. Also, two speaker drive channels are used in reality. Reference numerals 3 and 4 represent a selector switch unit for selecting two sources at the same time or one source from a plurality of sources, the selector switch unit 3 selecting a main source and the selector switch unit 4 selecting a sub-source.

Reference numeral 5 represents a digital signal processor for processing digital audio signals, for example, providing Dolby surround and the feeling of actual presence by reproducing surrounding sounds such as at an arena, a jazz club, a disco, a church, and a movie theater.

Reference numeral 6 represents a level adjustment unit for adjusting the level of the sub-source. Reference numeral 7 represents an adder having a switch therein for selecting desired inputs and adding them together to output the result to a desired output line.

Reference numeral 8 represents a balance adjustment volume for setting a level ratio of the sub-source to the main source. Reference numeral 9 represents a master volume for increasing or decreasing the levels of the main source and sub-source at the same time. Reference numeral 10 represents a keyboard for entering a command of controlling the selector switch units 3 and 4 and a command of selecting a sound field pattern and supplying it to the digital signal processor 5. These commands are supplied to a microcomputer 11.

Reference numeral 11 represents a one-chip microcomputer having a ROM, a RAM, and I/O interfaces. The microcomputer 11 operates in accordance with programs written in ROM and signals from the keyboard 10, and controls the selector switch units 3 and 4, digital signal processor 5, level adjustment unit 7, adder 7, balance adjustment volume 8, and master volume 9.

Figure 3:
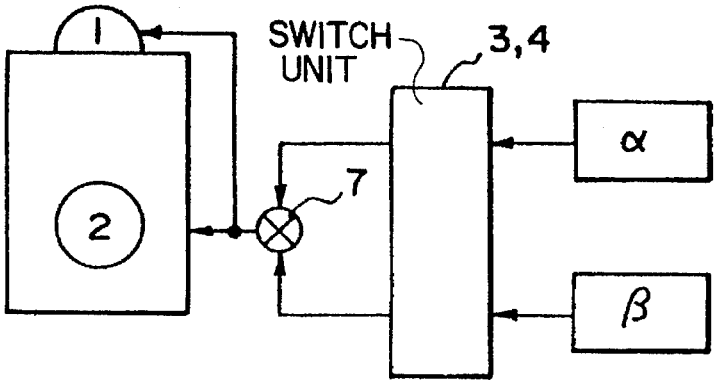
FIG. 3 is a block diagram showing the structure of an audio apparatus according to an embodiment of the present invention.

Various functions realized by the above-described hardware configuration will be described with reference to FIGS. 3 to 16. FIG. 3 is a block diagram explaining a first function of the audio apparatus. As shown, sources α and β are selected by the selector switch units 3 and 4, and added together by the adder 7 to drive the speakers 1 and 2 at the same time. Although amplifiers are not shown, the added source signal is amplified by power amplifiers to drive the speakers. This is also true for the following descriptions of other functions.

Figure 4:
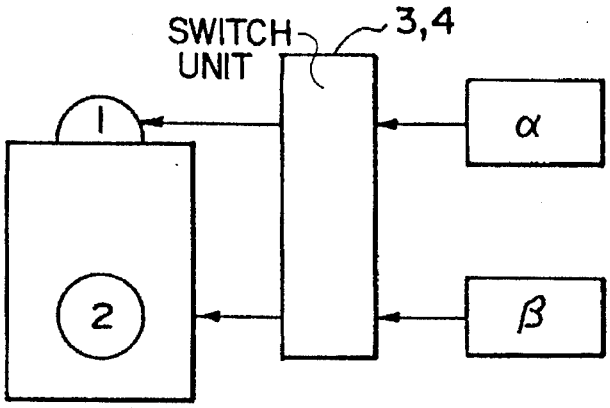
FIG. 4 is a block diagram showing the structure of an audio apparatus according to another embodiment of the present invention.

FIG. 4 is a block diagram explaining a second function of the audio apparatus. As shown, sources α and β are selected by the selector switch units 3 and 4, and drive the speakers 1 and 2 independently.

Figure 5:
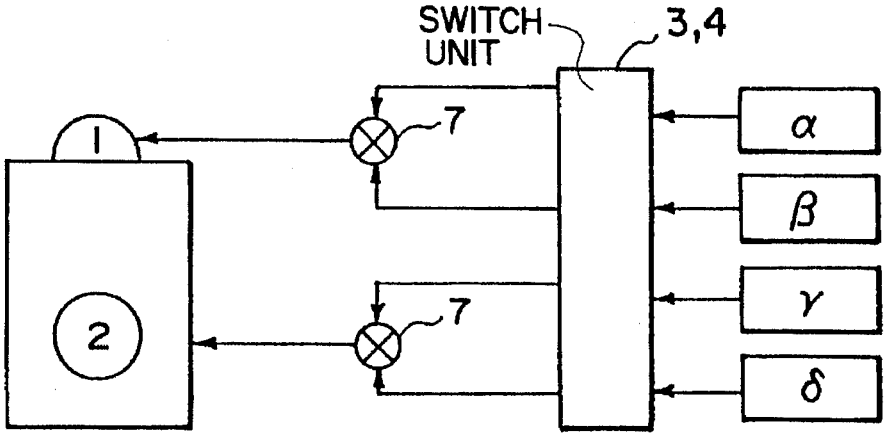
FIG. 5 is a block diagram showing the structure of an audio apparatus modified from the embodiment shown in FIG. 4.

FIG. 5 is a block diagram explaining a third function of the audio apparatus. As shown, sources α, β, γ, and δ are selected by the selector switch units 3 and 4. Two desired sources among the selected sources are added together by the adder 7 to drive the speakers 1 and 2 independently.

Figure 6:
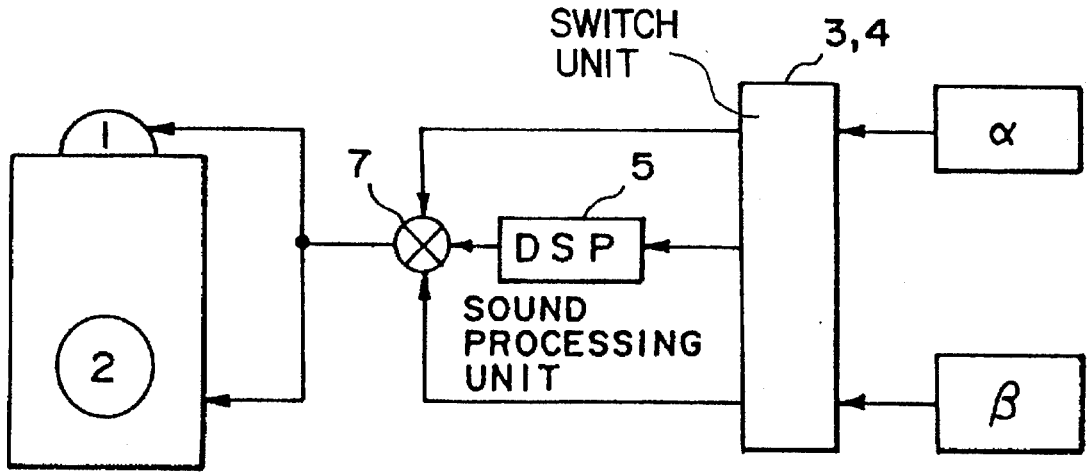
FIG. 6 is a block diagram showing the structure of an audio apparatus according to a further embodiment of the present invention.

FIG. 6 is a block diagram explaining a fourth function of the audio apparatus. As shown, sources α and β are selected by the selector switch units 3 and 4. One of the selected sources is subjected to a sound field processing by the digital signal processor 5 and added to the other source by the adder 7 to drive the speakers 1 and 2 at the same time.

Figure 7:
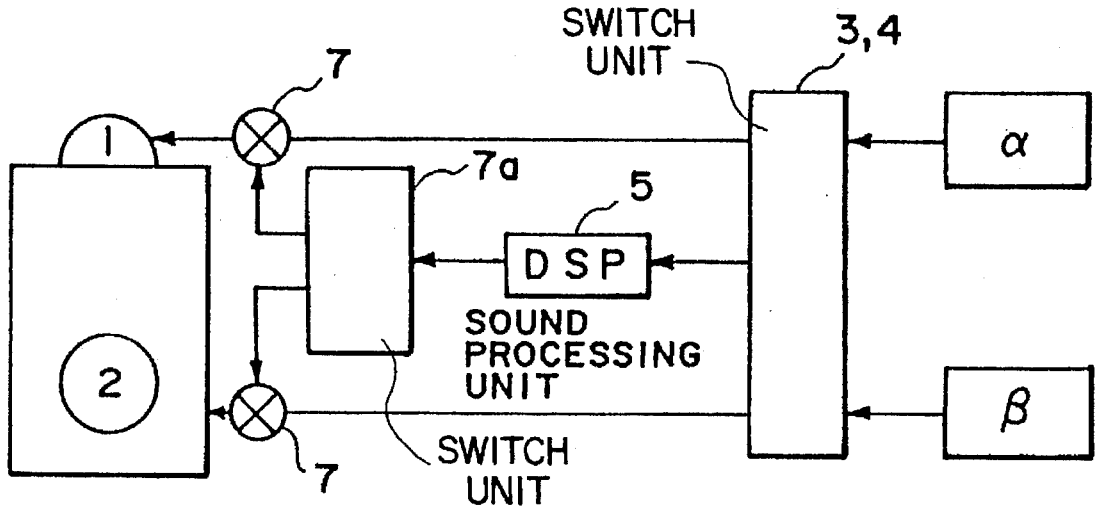
FIG. 7 is a block diagram showing the structure of an audio apparatus according to a still further embodiment of the present invention.

FIG. 7 is a block diagram explaining a fifth function of the audio apparatus. As shown, sources α and β are selected by the selector switch units 3 and 4. One of the selected sources is subjected to a sound field processing by the digital signal processor 5 and added to one of the sources selected by a switch unit 7*a* of the adder 7 by the adder 7. The obtained sources drive the speakers 1 and 2 independently.

Figure 8:
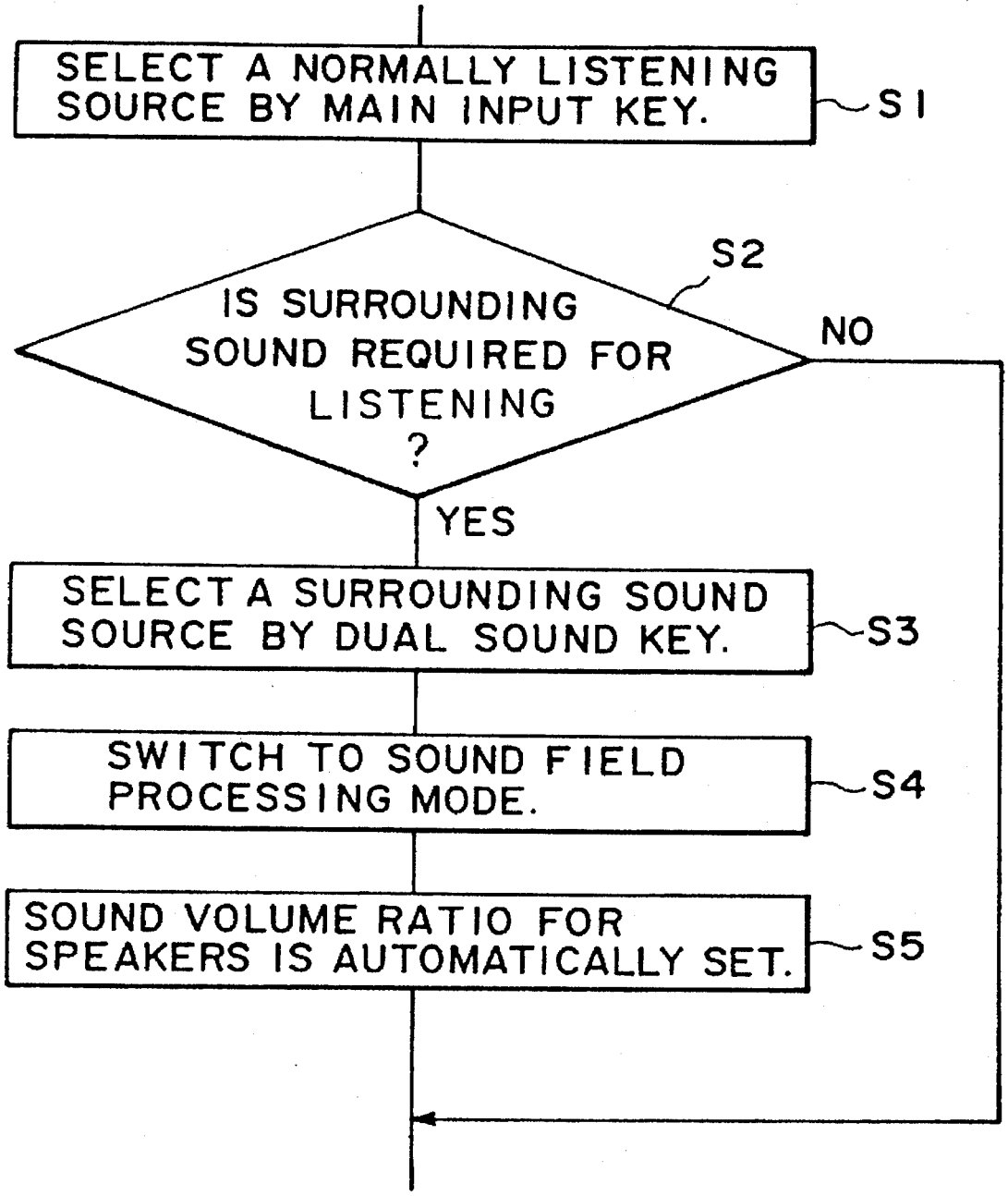
FIG. 8 is a flow chart explaining the operation of the audio apparatus shown in FIG. 7.

FIG. 8 is a flow chart explaining the operation procedure by the audio apparatus having the above-described functions. First, at Step S1 a MAIN INPUT key is depressed to select a normally listening source. At Step S2 a key enter is checked whether surrounding sounds are listened at the same time or not. If surrounding sounds are not listened, only the main source is played.

If surrounding sounds are to be listened, at Step S3 a DUAL SOUND key is depressed to select a surrounding sound source or sub-source. At Step S4 a sound field pattern is selected, and at Step S5 the volume ratio of the speakers 1 and 2 is set to a predetermined value to play a music program.

Figure 9:
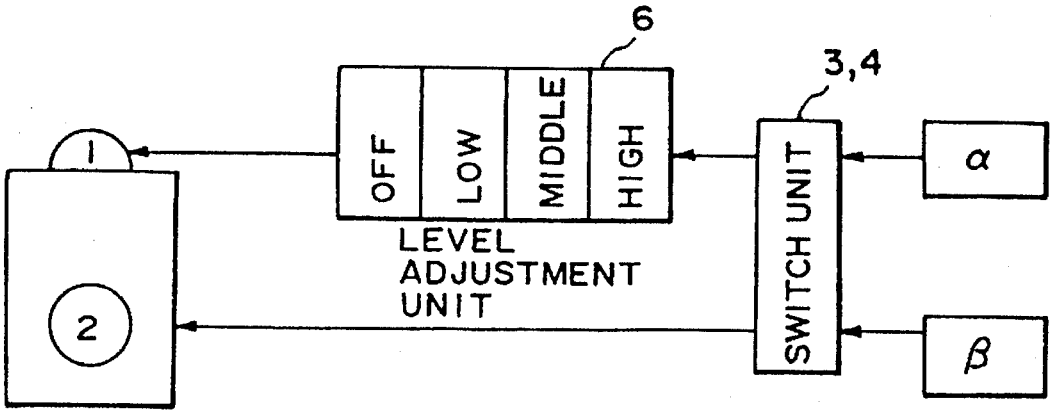
FIG. 9 is a block diagram showing the structure of an audio apparatus according to another embodiment of the present invention.

FIG. 9 is a block diagram explaining a sixth function of the audio apparatus. As shown, sources α and β are selected by the selector switch units 3 and 4. The source selected as the sub-source is level adjusted by the level adjustment unit 6. The main source and sub-source drive the speakers 1 and 2 independently.

Figure 10:
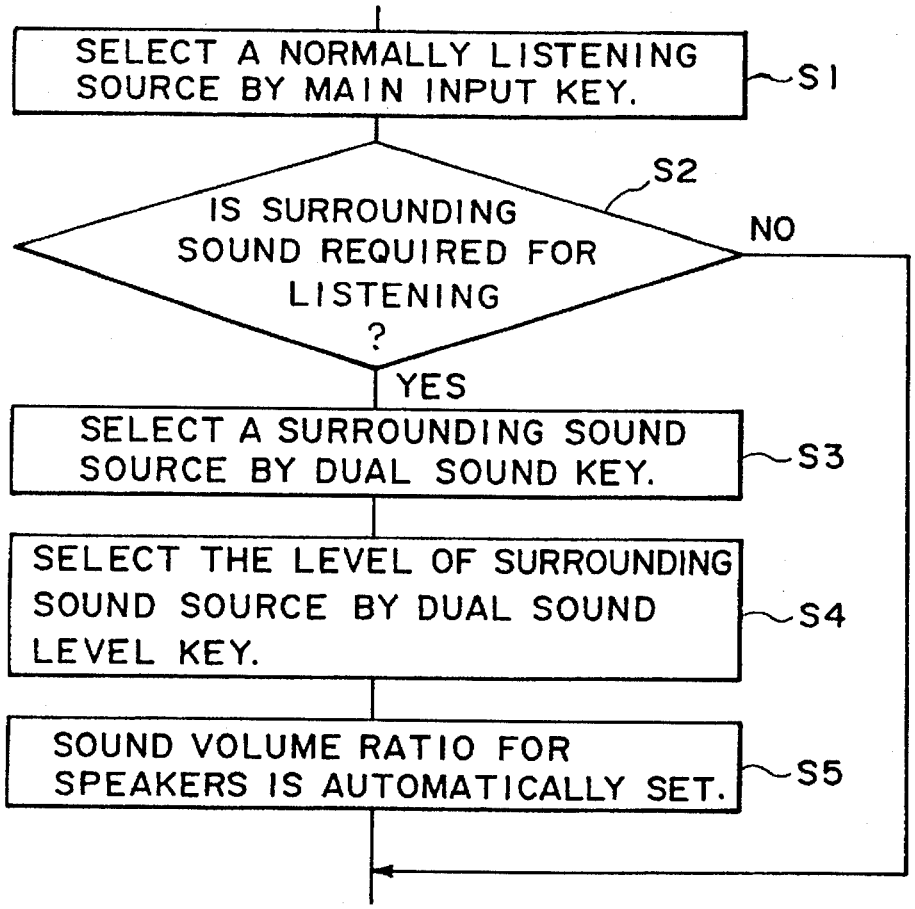
FIG. 10 is a flow chart explaining the operation of the audio apparatus shown in FIG. 9.

FIG. 10 is a flow chart explaining the operation procedure by the audio apparatus having the above-described function. First, at Step S1 the MAIN INPUT key is depressed to select a normally listening source. At Step S2 a key enter is checked whether surrounding sounds are listened at the same time or not. If surrounding sounds are not listened, only the main source is played.

If surrounding sounds are to be listened, at Step S3 the DUAL SOUND key is depressed to select a surrounding sound source or sub-source. At Step S4 a DUAL SOUND LEVEL key is depressed to set the level of the sub-source, and at Step S5 the volume ratio of the speakers 1 and 2 is set to a predetermined value to play a music program.

Figure 11:
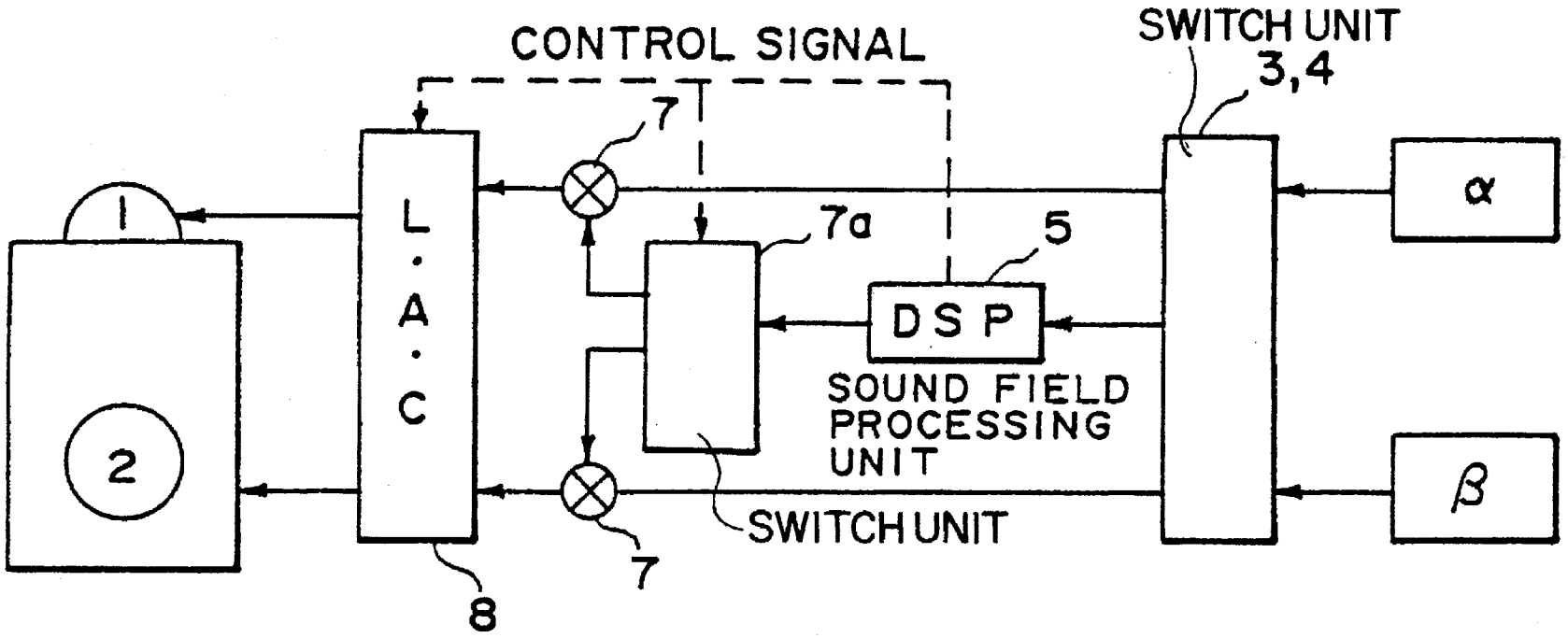
FIG. 11 is a block diagram showing the structure of an audio apparatus according to another embodiment of the present invention.

FIG. 11 is a block diagram explaining a seventh function of the audio apparatus. As shown, sources α and β are selected by the selector switch units 3 and 4. One of the selected sources is subjected to a sound field processing by the digital signal processor 5 and added to one of the sources selected by a switch unit 7*a* of the adder 7 by the adder 7. The obtained sources are level adjusted by the balance adjustment volume 8 to drive the speakers 1 and 2 independently.

Although the balance adjustment volume 8 and switch unit 7*a* are controlled by the sound field pattern set to the digital signal processor 5, the balance adjustment volume 8 may be manually controlled. The operation of the balance adjustment volume 8 may be made invalid depending upon a selected sound field pattern so as to set the volume ratio of the speakers 1 and 2 to a preset value. In this case, an indication of invalidness of the balance adjustment volume 8 is displayed.

Figure 12:
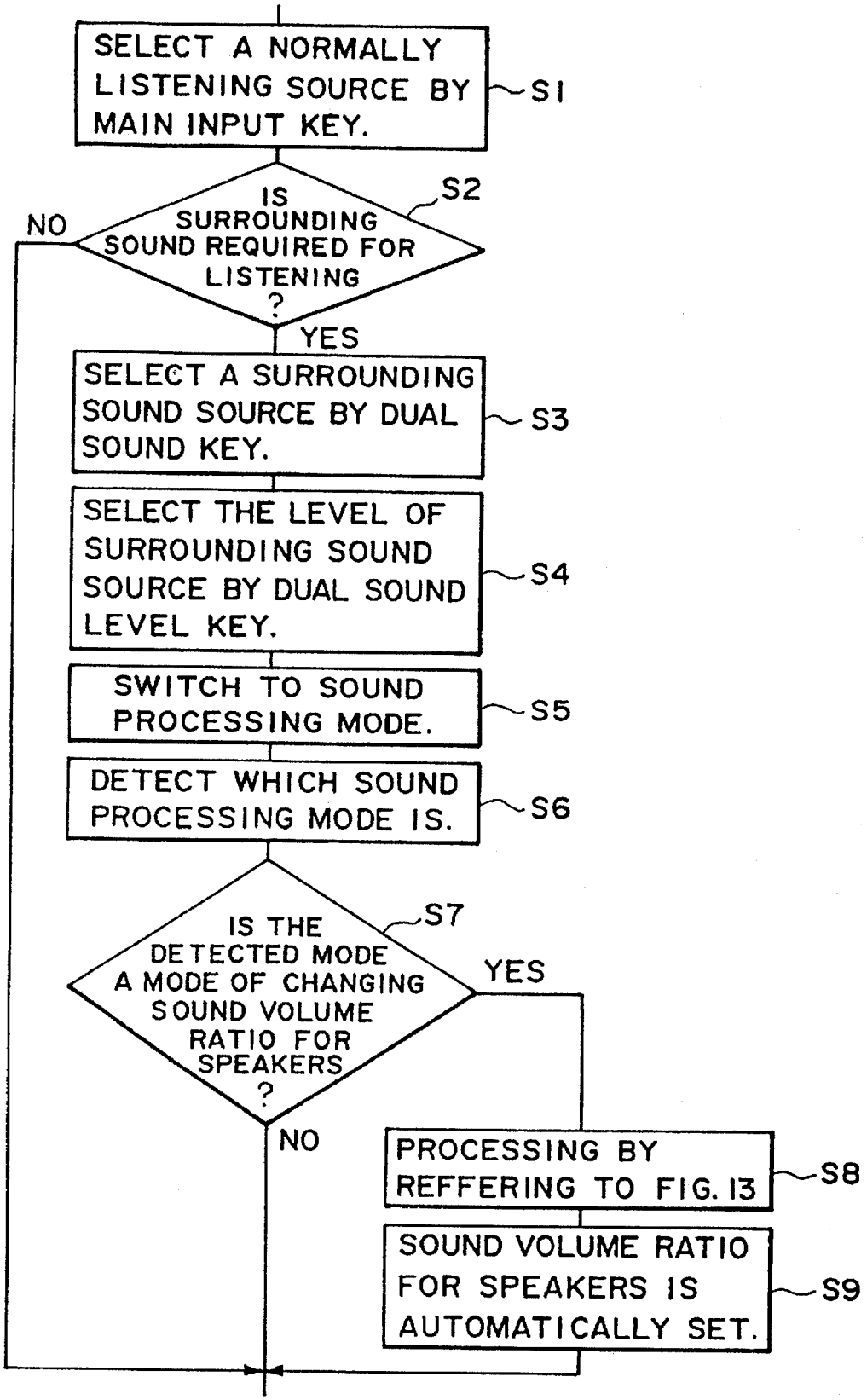
FIG. 12 is a flow chart explaining the operation of the audio apparatus shown in FIG. 11.

FIG. 12 is a flow chart explaining the operation procedure by the audio apparatus having the above-described function. First, at Step S1 the MAIN INPUT key is depressed to select a normally listening source. At Step S2 a key enter is checked whether surrounding sounds are listened at the same time or not. If surrounding sounds are not listened, only the main source is played.

If surrounding sounds are to be listened, at Step S3 the DUAL SOUND key is depressed to select a surrounding sound source or sub-source. At Step S4 the DUAL SOUND LEVEL key is depressed to set the level of the sub-source, at Step S5 a sound field pattern is selected, and at Step S6 the selected sound field pattern is identified.

At Step S7 it is checked whether the identified sound field pattern is a sound processing pattern or mode of changing the volume ratio for the speakers 1 and 2. If affirmative, at Steps 8 and 9, a musical program is played at the volume ratio corresponding to the identified sound processing pattern as shown in FIG. 13. If not affirmative, a musical program is played at the preset fixed volume ratio for the speakers 1 and 2.

Figure 14:
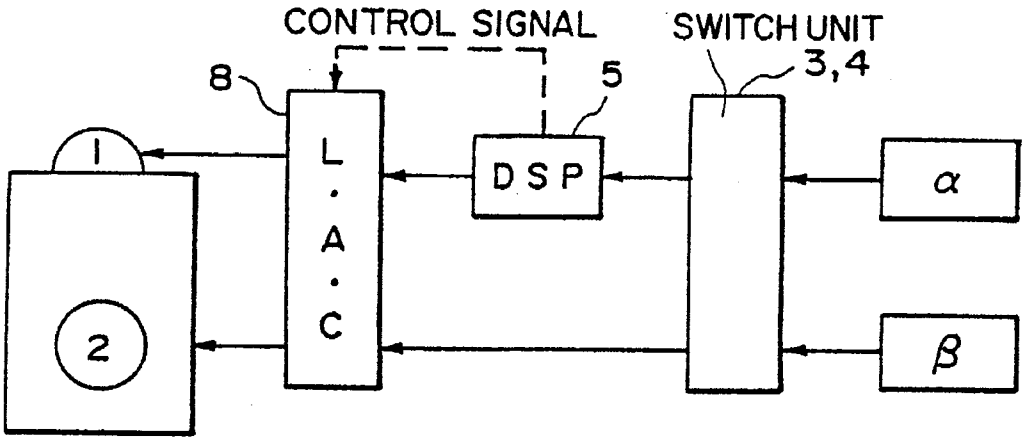
FIG. 14 is a block diagram showing the structure of an audio apparatus according to another embodiment of the present invention.

FIG. 14 is a block diagram explaining an eighth function of the audio apparatus. As shown, sources α and β are selected by the selector switch units 3 and 4. The source selected as the main source is subjected to a sound field processing by the digital signal processor 5. The volume ratio of the obtained main source and sub-source is set by the balance adjustment volume 8 to thereafter drive the speakers 1 and 2 independently. Although the balance adjustment volume 8 sets the volume ratio in accordance with the selected sound field pattern, the operation thereof is made invalid depending upon a selected sound field pattern. This operation is controlled in the manner described with reference to FIGS. 12 and 13.

Figure 15:
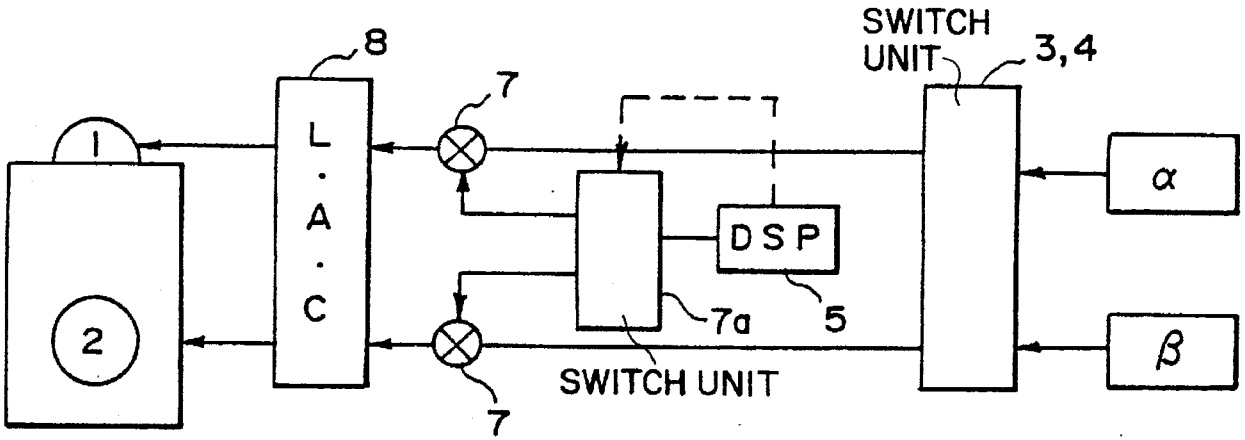
FIG. 15 is a block diagram showing the structure of an audio apparatus according to another embodiment of the present invention.

FIG. 15 is a block diagram explaining a ninth function of the audio apparatus. As shown, sources α and β are selected by the selector switch units 3 and 4. One of the sources selected as the main source is subjected to a sound field processing by the digital signal processor 5.

This processed source is added to the source selected by the switch unit 7*a* of the adder 7 by the adder 7. The volume ratio of the obtained sources is set by the balance adjustment volume 8 so as to drive the speakers 1 and 2 independently. Although the balance adjustment volume 8 is manually controlled, the operation thereof is made invalid depending upon a selected sound field pattern.

Figure 16:
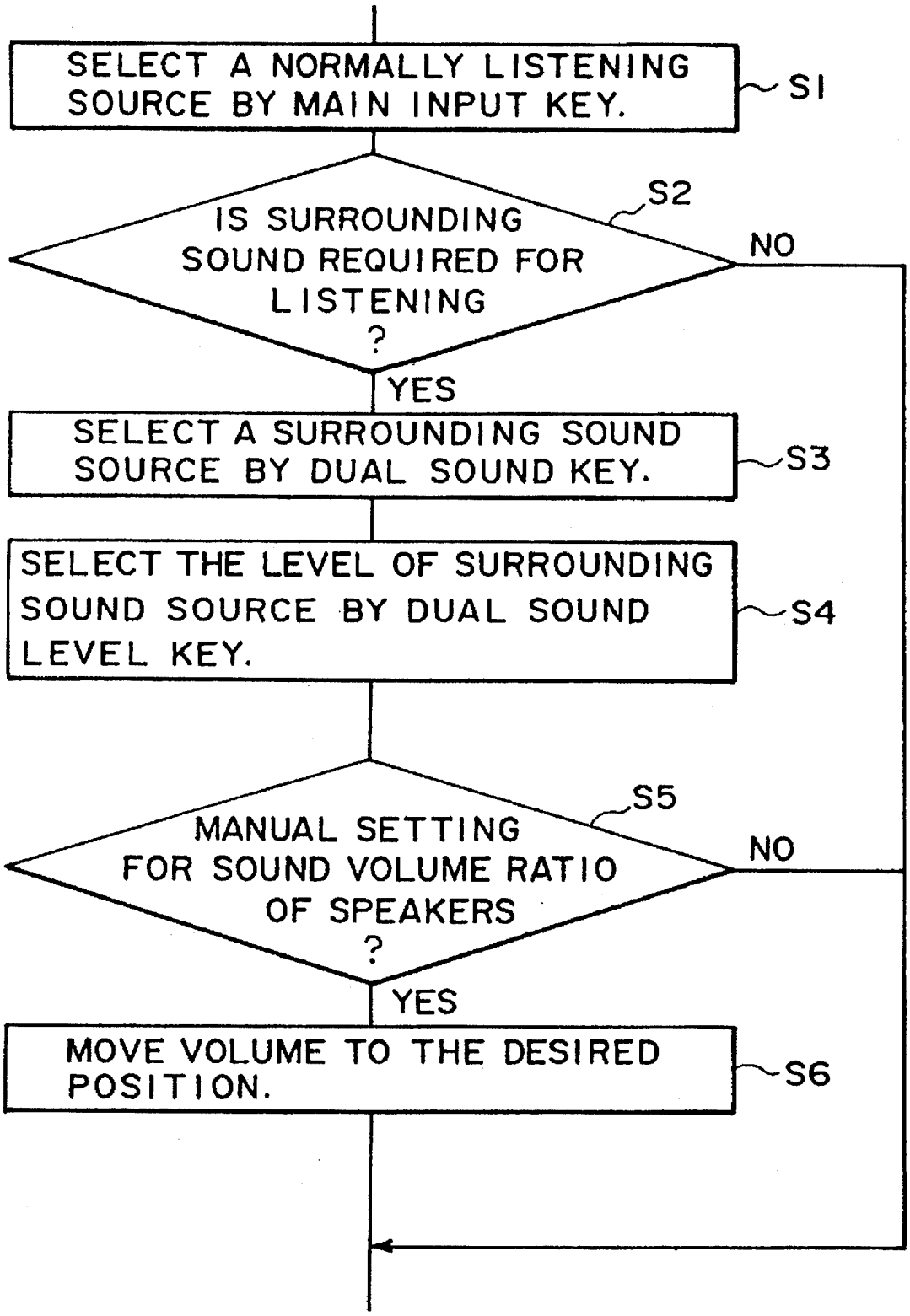
FIG. 16 is a flow chart explaining the operation of the audio apparatus shown in FIG. 15.
Figure 17A:
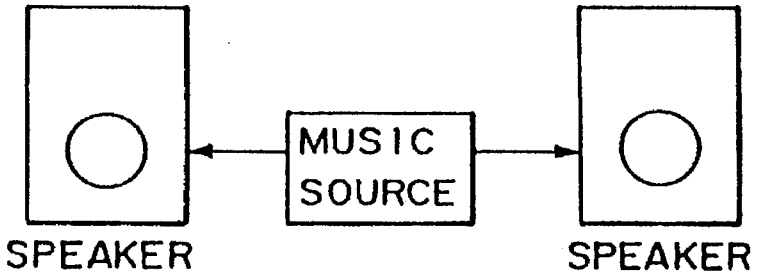
FIGS. 17A and 17B are block diagrams showing the structures of conventional audio apparatuses.
Figure 17B:
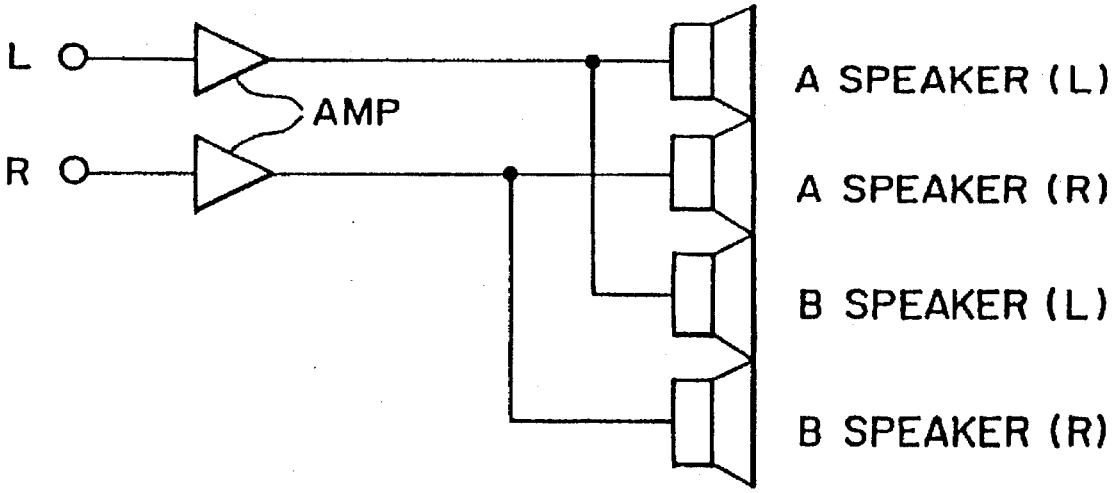

FIG. 16 is a flow chart explaining the operation procedure by the audio apparatus having the above-described function. First, at Step S1 the MAIN INPUT key is depressed to select a normally listening source. At Step S2 a key enter is checked whether surrounding sounds are listened at the same time or not. If surrounding sounds are not listened, only the main source is played.

If surrounding sounds are to be listened, at Step S3 the DUAL SOUND key is depressed to select a surrounding sound source or sub-source. At Step S4 the DUAL SOUND LEVEL key is depressed to set the level of the sub-source.

At Step S5 a key enter is checked whether the volume ratio for the speakers 1 and 2 is set manually or not. If not, a music program is played at the preset fixed volume ratio for the speakers 1 and 2. If manually set, at Step S6 the balance adjustment volume 8 is manually set. The operation of the balance adjustment volume 8 is made invalid depending upon the selected sound field pattern.

According to the audio apparatus of this invention, music can be listened with a sense of nature and season by selecting desired sources.

Music can be enjoyed much by reproducing surrounding sounds such as hum of voices and cheers at a concert hall, jazz club, stadium, or the like.

By automatically setting the balance adjustment volume, optimum surrounding sounds matching a musical program can be automatically reproduced.

What is claimed is:

1. An audio apparatus comprising:

L-channel speakers including two speakers respectively having different directivities;

R-channel speakers including two speakers respectively having different directivities;

switching means for designating at least two sources from a plurality of sources;

sound field processing means for processing the sound field of at least one source sound a signal designated by said switching means; and an adder for adding an output of said sound field processing means to a source sound signal other than said source sound signal processed by said sound field processing means, wherein a source sound signal obtained by adding a plurality of source sound signals from said two source designated by said switching means, and source sound signals not subjected to addition respectively drive said R-channel speakers of different directivities and said L-channel speakers of different directivities independently.

2. The audio apparatus of claim 1 wherein said L-channel speakers include at least one omnidirectional speaker and at least one directional speaker and said R-channel speakers include at least one omnidirectional speaker and at least one directional speaker.

3. An audio apparatus comprising:

L-channel speakers including two speakers respectively having different directivities;

R-channel speakers including two speakers respectively having different directivities;

switching means for designating at least two sources from a plurality of sources;

sound field processing means for processing the sound field of at least one source sound signal designated by said switching means;

an adder for adding an output of said sound field processing means to a source sound signal other than said source sound signal processed y said sound field processing means; and level adjusting means for adjusting the levels of a source sound signal obtained by the addition of said adder and a source sound signal not subjected to the addition of said adder, wherein said level adjusting means is manually set, and the signals whose levels have been set by said level adjusting means drive said R-channel speakers of different directivities and said L-channel speakers of different directivities independently, and wherein the operation of said level adjusting means is made invalid depending upon a particular sound field pattern set by said sound field processing means, and the level ratio of the source sound signals for driving said R-channel speakers of different directivities and said L-channel speakers of different directivities is fixed to a predetermined level ratio.

4. The audio apparatus of claim 3 wherein said L-channel speakers include at least one omnidirectional speaker and at least one directional speaker and said R-channel speakers include at least one omnidirectional speaker and at least one directional speaker.

* * * * *